United States Patent [19]

Crow

[11] Patent Number: 4,484,682

[45] Date of Patent: Nov. 27, 1984

[54] CONTAINER WITH MAGNET FOR HOLDING IT IN POSITION

[76] Inventor: Robert T. Crow, 3407 E. Laurel La., Phoenix, Ariz. 85028

[21] Appl. No.: 501,496

[22] Filed: Jun. 6, 1983

[51] Int. Cl.[3] ..... A45C 11/20

[52] U.S. Cl. ..... 206/545; 206/541; 206/818; 220/69; 248/206.5; 335/285; 335/286; 335/303

[58] Field of Search ..... 206/541–550, 206/818; 220/18, 69, 23.83, 23.86; 335/209, 219, 285, 286, 303; 248/206.5

[56] References Cited

U.S. PATENT DOCUMENTS

| | | | |
|---|---|---|---|
| 580,899 | 4/1897 | Roberts | 220/22 |
| 876,427 | 1/1908 | Benson | 206/44.11 |
| 2,153,566 | 4/1939 | Jewett et al. | 206/44.11 |
| 2,499,254 | 2/1950 | Parker | 206/545 |
| 2,645,332 | 7/1953 | Martin et al. | 206/546 |
| 2,672,232 | 3/1954 | Kessell, Jr. | 206/543 |
| 3,156,105 | 11/1964 | Bahner | 62/457 |
| 3,164,696 | 1/1965 | Pusch | 335/207 |
| 3,257,586 | 6/1966 | Steingroever | 335/303 |
| 3,613,872 | 10/1971 | Donnelly | 206/545 |
| 3,979,007 | 9/1976 | Thornbloom, Jr. | 220/96 |
| 4,106,597 | 8/1978 | Shook et al. | 206/545 |
| 4,280,336 | 7/1981 | Taylor | 220/902 |

FOREIGN PATENT DOCUMENTS

| | | | |
|---|---|---|---|
| 237525 | 4/1964 | Austria | 335/285 |
| 1348460 | 12/1963 | France | 206/818 |

*Primary Examiner*—William T. Dixson, Jr.
*Assistant Examiner*—Jimmy G. Foster
*Attorney, Agent, or Firm*—Cahill, Sutton & Thomas

[57] ABSTRACT

A portable container for food and miscellany capable of protecting and preserving its contents in the rough handling environment of the construction worker. The container comprises an insulated hollow body with a compartmented, covered tray therein and a hinged, insulated lid for closing the body and for holding the tray in place within the body. The body also has a permanent magnet in the bottom thereof for holding the container in place on a magnetically attractable surface.

10 Claims, 13 Drawing Figures

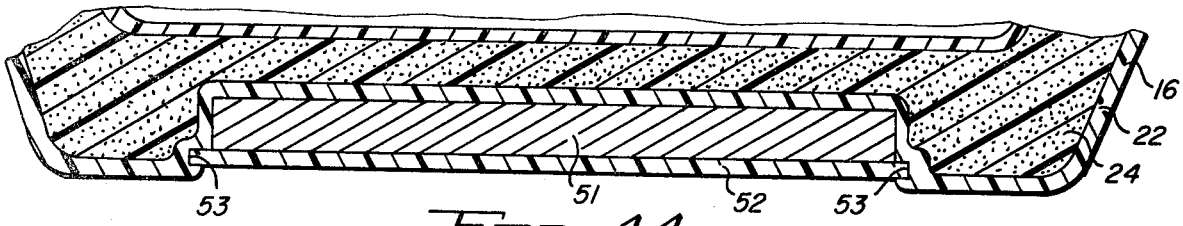
FIG. 11
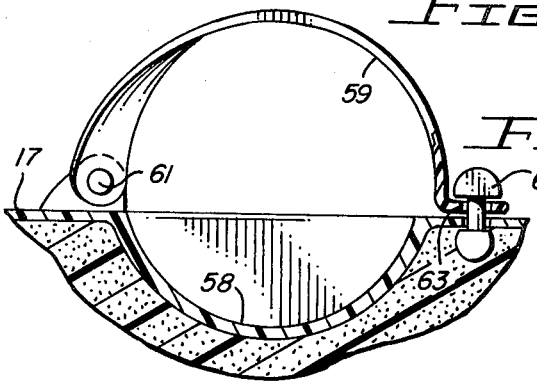
FIG. 12
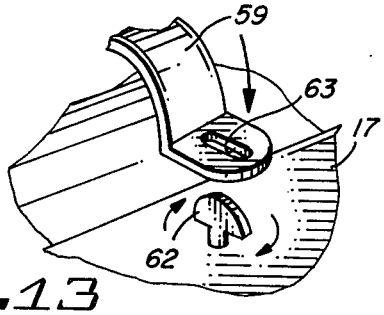
FIG. 13
FIG. 7
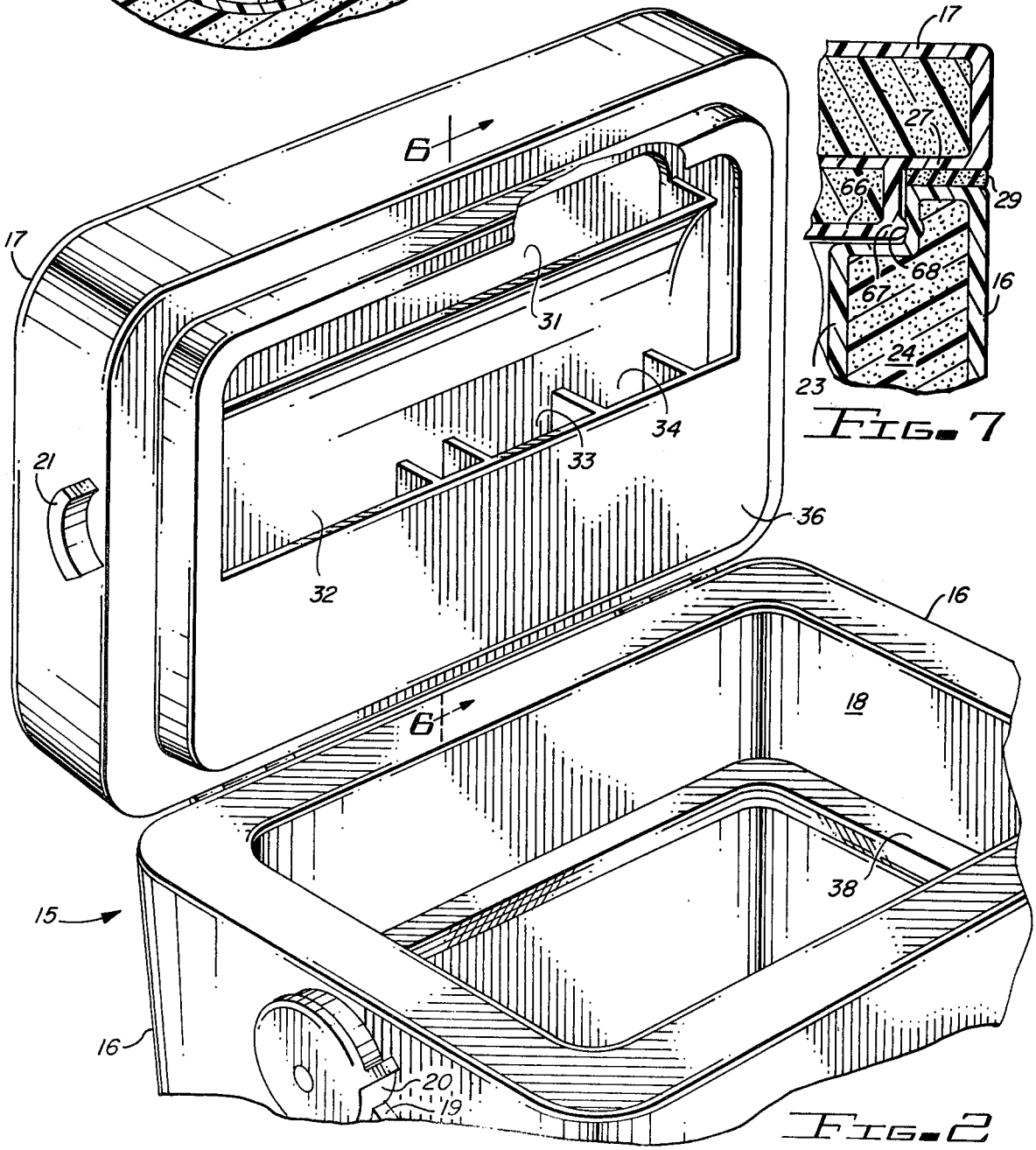
FIG. 2

FIG. 3
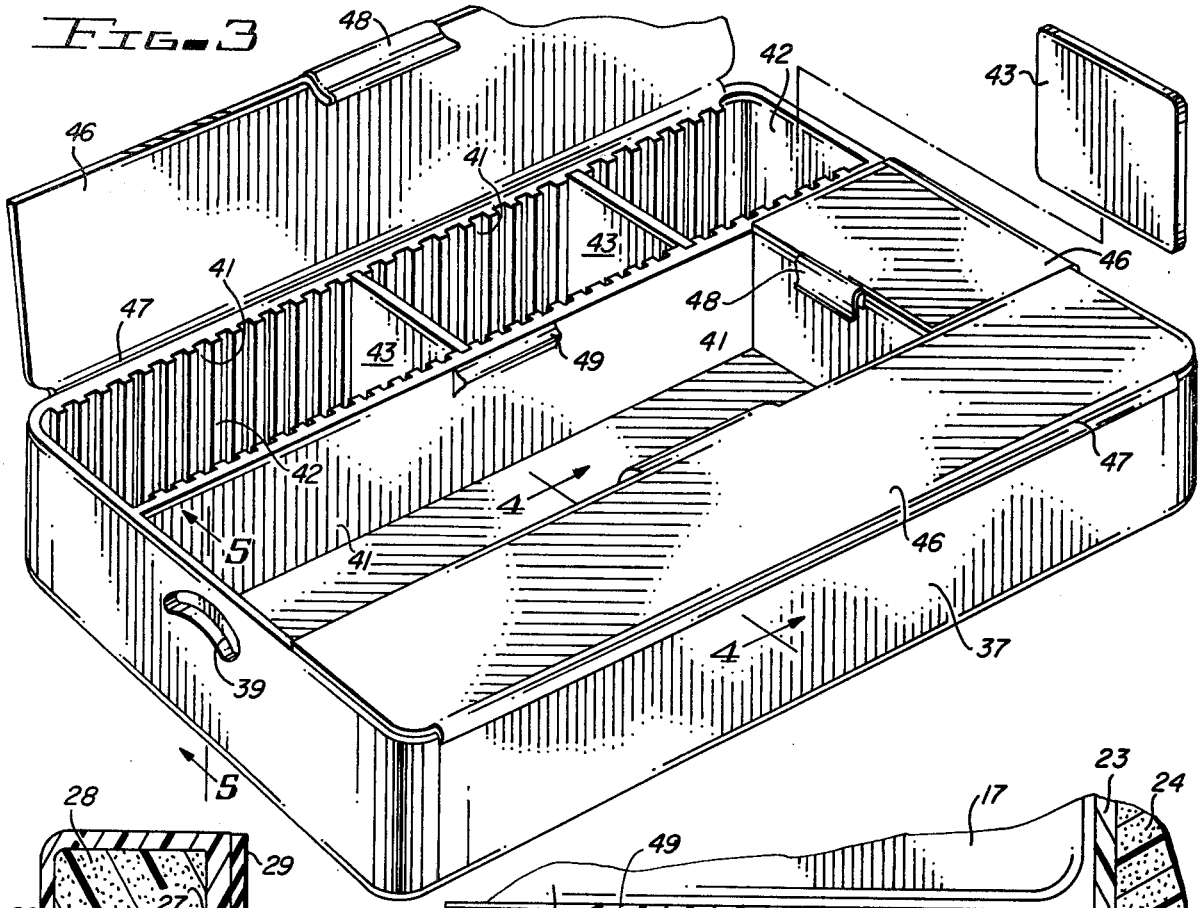
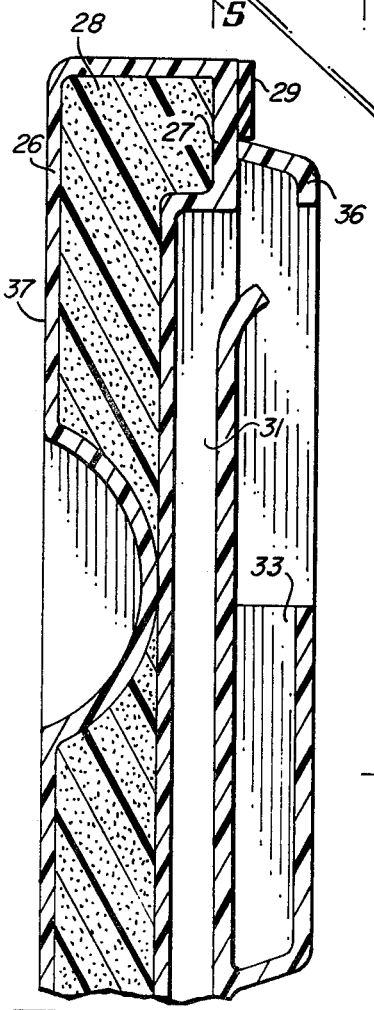
FIG. 6
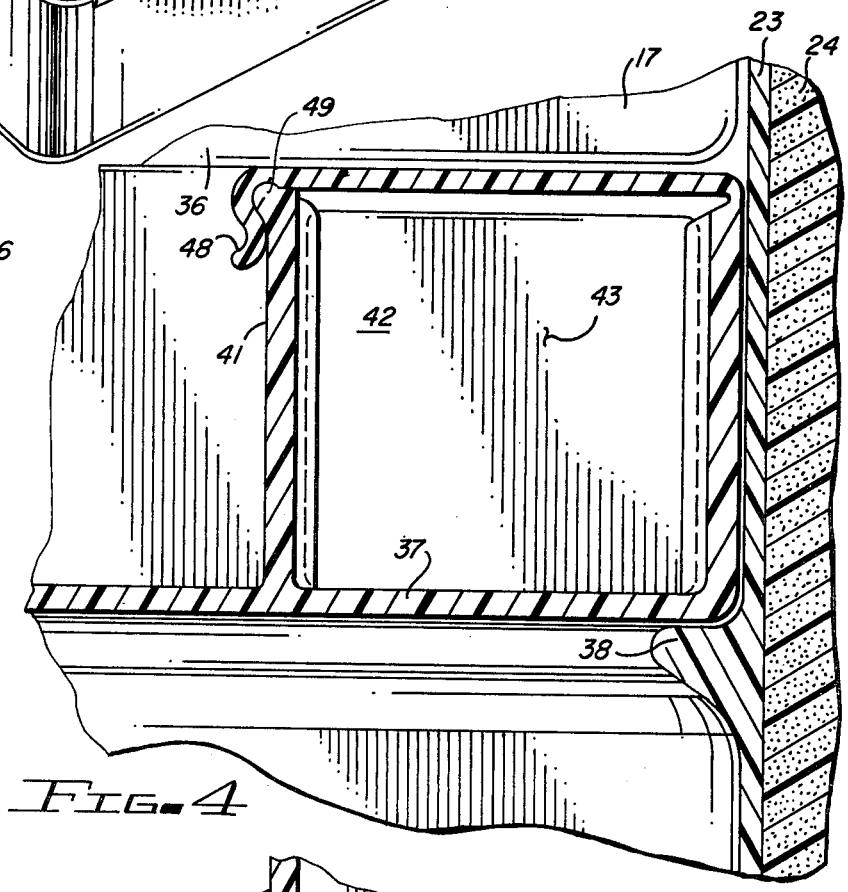
FIG. 4
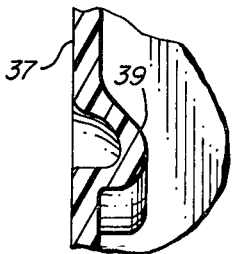
FIG. 5

CONTAINER WITH MAGNET FOR HOLDING IT IN POSITION

TECHNICAL FIELD

This invention provides an improved, portable container for preserving and protecting food and miscellany in environments such as are encountered by construction workers.

BACKGROUND ART

The lunch pail, or box, has been a common companion to the construction worker for many years. In its most common form, the lunch pail is adapted to contain the ingredients for a lunch, such as sandwiches, fruit, and a beverage, and little else. In recent times, however, the common lunch box has been replaced by more elaborate containers which, in some instances, have been formed of heat insulating material capable of maintaining the contents thereof either below room temperature to preserve the contents, or at elevated temperatures to make the food contained therein more palatable. Containers along these lines are disclosed in U.S. Pat. No. 2,499,254 granted Feb. 28, 1952, to C. Parker for "Thermos Lunch Box" and U.S. Pat. No. 2,672,232 granted Mar. 16, 1954 to W. Kessell, Jr. for "Lunch Box with Vacuum Containers". Some lunch boxes have even been equipped with electric heaters as is exemplified by U.S. Pat. No. 2,611,851 granted Sept. 23, 1952 to F. H. Lott for "Heated Lunch Pail".

The lunch pails of the prior art have, however, been deficient in one or the other of two major requirements of a portable container for use by construction workers in their environment. The first requirement is that the container be sufficiently versatile to be adapted to carry a variety of food items and other miscellaneous items of various sizes and shapes. Ideally, the container should be compartmented to snugly support the items which are stored therein so as to prevent their movement about in a damaging fashion as the container is subjected to the usual rough and tumble handling which is inevitable in the construction environment. The second requirement usually not met by prior art lunch pails is that some means be provided for securing the container in place on a stable surface to reduce the likelihood of the container being knocked over or dropped a considerable distance with resultant damage to the container and its contents.

DISCLOSURE OF THE INVENTION

Like some prior art lunch pails, the portable container of this invention utilizes an insulated hollow body having a top opening and a hingedly mounted insulated lid for closing the opening in the body. Among the improvements for the container, however, is a compartmented tray adapted to occupy an upper region of the container body and which is provided with movable dividers and cover members by which the tray can be adapted to snugly hold various food items or other items which the worker wishes to carry along with him. The lower region of the body is adapted to receive means for either absorbing heat or giving off heat to, respectively, cool or heat the food items in the compartmented tray. In addition, the insulated lid of the container is preferably equipped with compartments for holding items such as a newspaper, a notebook, pencils, sun glasses and other miscellany. Means are provided for locking the lid of the container in its closed position on the container body and when in this position the lid closely confines the tray inside the body so that it is kept from moving about within the body when the container is subjected to rough handling. A further important feature of the portable container of this invention is the inclusion of magnetic means in the bottom of the container body by which the container can be secured to a magnetically attractable surface, such as a metal girder of a building under construction or a portion of a piece of mechanized construction equipment which the worker is manipulating. The magnetic means, of course, keeps the container from being accidentally dislodged from its resting place. It is preferred that the container be further equipped with means for reducing the attractive force of the magnet to facilitate removal of the container from the surface to which it is magnetically attracted.

With the magnet means being capable of reducing the likelihood that the container will be displaced from its resting place accidentally and the food items and other miscellaneous items being confined against substantial movement and contact with each other within the portable container, the chances of the contents of the container being damaged in use are greatly reduced over the chances of damage to like contents in prior containers.

BRIEF DESCRIPTION OF THE DRAWINGS

Fig. 2 is a partial perspective view of the container of FIG. 1 shown with the lid of the container in open position;

FIG. 3 is a ¾ perspective view from above of a compartmented tray adapted to be stored in the container;

FIG. 4 is a sectional view through the tray of FIG. 3 illustrating the manner in which the tray is stored within the container;

FIG. 5 is a sectional view through a wall of the compartmented tray taken as indicated generally by line 5—5 of FIG. 3;

FIG. 6 is a partial sectional view taken through the lid of the container generally as indicated by the line 6—6 in FIG. 2;

FIG. 7 is a vertical, sectional view through the lid and sidewall of the container body;

Fig. 11 is a sectional view through the bottom of the container body taken generally as indicated by line 11—11 in FIG. 8;

FIG. 12 is a vertical sectional view through a portion of the lid of the container and showing the construction of an optional hold down strap for a drink bottle; and FIG. 13 is a partial perspective view illustrating a thumb latch detail of the hold down strap of FIG. 12.

BEST MODE FOR CARRYING OUT THE INVENTION

Figure 1:
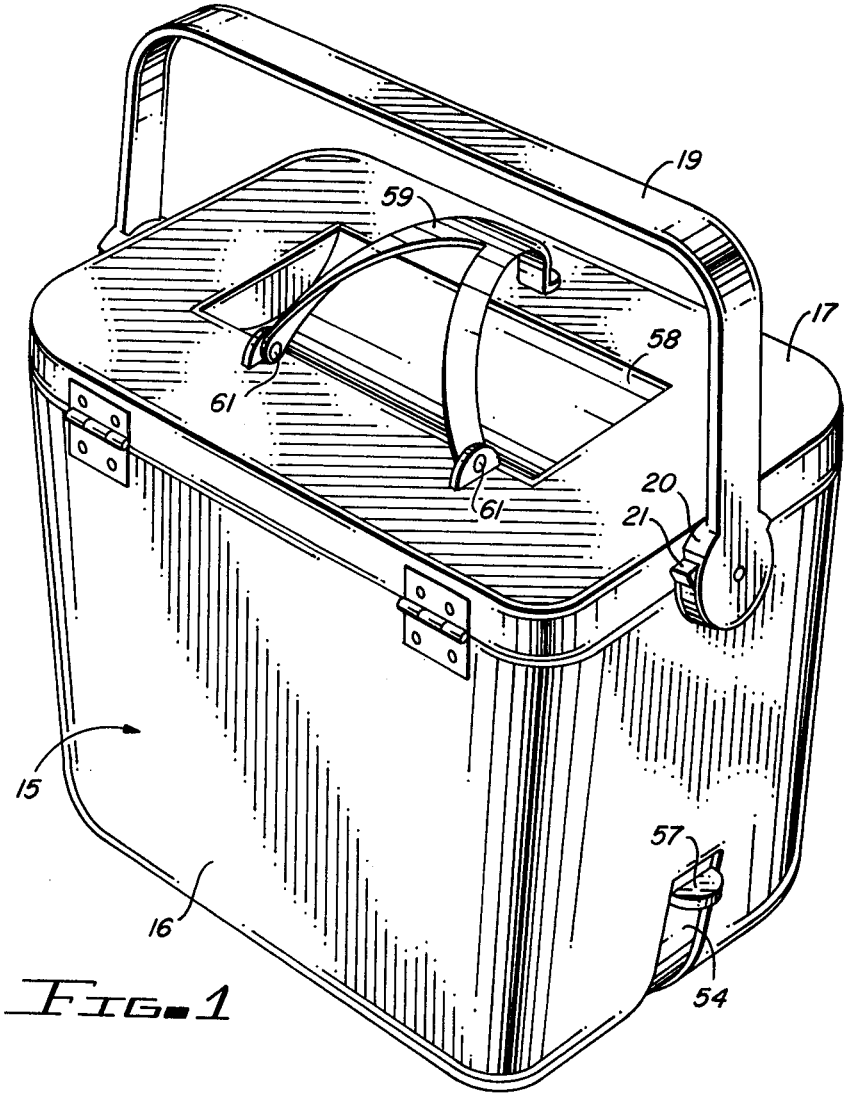
FIG. 1 is a ¾ perspective view from above of a portable container constructed in accordance with this invention.

Referring particularly to FIGS. 1 and 2, the portable container of this invention is identified generally by reference numeral 15 and comprises a hollow body 16 having a lid, or cover 17, hingedly secured thereto and adapted to close a top opening 18 in the container body 16. The container 15 also preferably includes a carrying handle 19 swingably mounted on the container body and movable from the upright, or carrying position shown in FIG. 1 to a lowered position, indicated in FIG. 2, to permit the container lid 17 to be moved to its open position as shown in FIG. 2. The carrying handle 19 may also, if desired, be equipped with latching means in the form of a latch member 20 formed at each end of the handle and adapted to engage a latch boss 21 formed at each side edge of lid 17 for latching the cover in its closed position as shown in FIG. 1 and for releasing the lid when the handle is moved to the position as shown in FIG. 2.

The side and bottom walls of container body 16 are preferably insulated to reduce the transmission of heat therethrough. To this end, container body 16 is preferably constructed of a molded plastic outer shell 22 and a spaced inner liner 23 also constructed of molded plastic material. Disposed between the outer shell 22 and the inner liner 23 is heat insulation material 24 (see FIG. 10). The outer shell 22 and inner liner 23 are preferably formed of impact resistant plastic material, such as polyethylene, and the insulation 24 is preferably a foamed polyurethane material which has good heat insulating characteristics.

Container lid 17 is also insulated to reduce the transmission of heat threto and its construction may take the form of a molded outer shell 26 and an inner panel 27 also formed of molded plastic material. The space between the lid outer shell 26 and its inner panel 27 is preferably filled with an insulation material 28 similar to that employed in the body of the container (See FIG. 6). The periphery of the inner panel of lid 17 is preferably equipped with a sealing gasket 29 for sealing against the top edge of container body 16.

The inner panel 27 of lid 17 is preferably constructed to provide a plurality of storage compartments for miscellaneous items useful to the worker carrying the container. As best shown in FIGS. 2 and 6, these compartments in panel 27 are intended to be accessible when lid 17 is in its open position and may take the form of a newspaper compartment 31, a log or rulebook compartment 32, a glasses case compartment 33 and a miscellaneous storage compartment 34. These compartments and the access openings thereto are preferably provided by means of a separate molded plastic frame member 36 which is secured to the inner face of lid inner panel 27 (see FIG. 6).

The container body 16 is adapted to receive in an upper region thereof a compartment storage tray 37 which rests on a peripheral ledge 38 molded into the inner surface of the body inner liner 23. The uppermost regions of storage tray 37 are in close proximity to portions of the lid 17, such as the compartment frame member 36 (see FIG. 4) so that the lid, when closed, prevents any substantial displacement of the tray 37 from its support ledge 38. When lid 17 is open, of course, tray 37 is accessible and removable from body 16. To facilitate removal of the tray, one end thereof may have a finger engaging lip 39 molded therein which can be grasped by the user to lift and remove the tray (see FIG. 5).

In accordance with this invention tray 37 is constructed in such a manner as to closely confine various items of food and miscellany which are stored therein. To this end, the tray is equipped with a series of partitions 41 capable of defining with the sidewalls of the tray a plurality of compartments 42. The sizes of the compartments 42 are preferably adjustable by moving movable dividers 43 which slide into receptor slots 44 molded in the faces of the tray sidewalls and partitions 41.

The virtue of using the movable dividers 43 to change the size of storage compartments 42 is that the compartments can be made to snugly receive and protect the various items to be stored in the tray. These items might include, for example, sandwiches, fresh fruit, tobacco, cigarettes, snuff, a watch, etc. Added protection for the items stored in tray 37 may be provided by hinged covers 46. If the tray 37 is molded from semi-flexible plastic material, such as polyethylene, the covers 46 can be molded simultaneously with the remainder of the tray and attached to the main body of the tray by thin hinge sections indicated at 47. The tray covers 46 also have preferably molded thereon spring catch members 48 which snap over protuberances 49 molded in the tray partitions 41 to hold the covers 46 in their closed positions.

The lower region of container body 16, i.e., the space beneath the tray 37, is intended to be used primarily as a heat sink. In other words, this space can contain ice or other means for absorbing heat if it is desired to keep the contents of the container chilled. Alternatively, the space beneath tray 37 can contain material capable of emitting heat if it is desired to keep the contents of the container warm. Moreover, if the contents of tray 37 have been previously chilled or heated, the space beneath the tray may be used for storage of other miscellaneous items as the user desires. In such case, the insulated walls of the body and lid keep the contents of the container from undergoing any significant temperature change.

Figure 8:
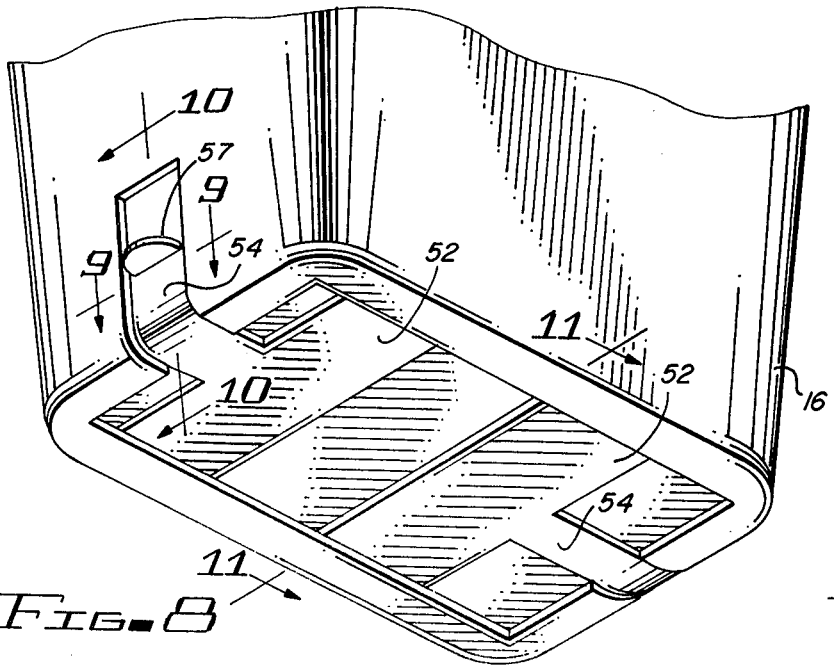
FIG. 8 is a ¾ perspective view taken from below of a portion of the container and illustrating the magnetic means in the bottom wall of the container body.

In the rough and tumble world of the construction worker, the lunch pail is frequently subjected to extremely rough handling which can damage its contents. In accordance with this invention, container 15 is equipped with means for securing the container to, say, a girder of a building under construction or a vehicle being manipulated by the user of the container. In this manner, the container 15 is protected from damage which might ensue from its being accidentally knocked from the girder or from being jostled off of the construction vehicle. This attachment means preferably includes magnet means located in the bottom wall of the container body 16. This magnet means preferably takes the form of a sizable permanent magnet 51 disposed in a recess in the bottom wall of container body 16 (see FIGS. 8 and 11). When container 15 is seated upon a magnetically attractable surface, such as a girder or a portion of a construction vehicle, the magnet 51 will hold the container in place and prevent accidental displacement. To facilitate removal of container 15 from its resting place it is preferred that the container be equipped with means for reducing the magnetic attraction which magnet 51 can exert to the supporting surface. Although various means may be utilized to accomplish this reduction in the attractive force of magnet 51, it is preferred that this be accomplished by means of a pair of shunt shields 52 which when disposed over the face of magnet 51 are capable of shunting the magnetic field so that a substantial portion thereof never reaches the magnetically attractable surface on which the container rests. The shields 52 may be formed of molded vinyl plastic material impregnated with iron fillings or other metallic powder.

Shields 42 are semiflexible and can be snapped into place in groove-like tracks 53 molded into the bottom wall of container outer shell 22 (see FIG. 11). Shields 52 are free to slide in tracks 53 and may occupy a position over the lower face of magnet 51 or be withdrawn toward the side of container body 16 to expose the face of the magnet 51 (see FIG. 8 wherein one of the shields had been partially withdrawn).

Figure 9:
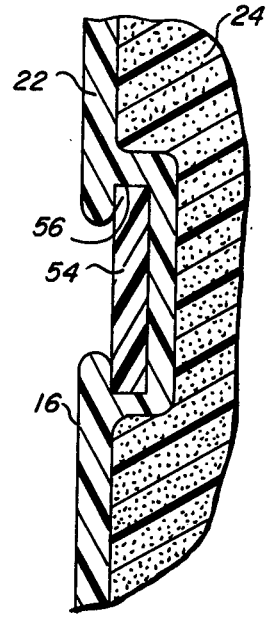
FIG. 9 is a sectional view taken generally as indicated by line 9—9 in FIG. 8.
Figure 10:
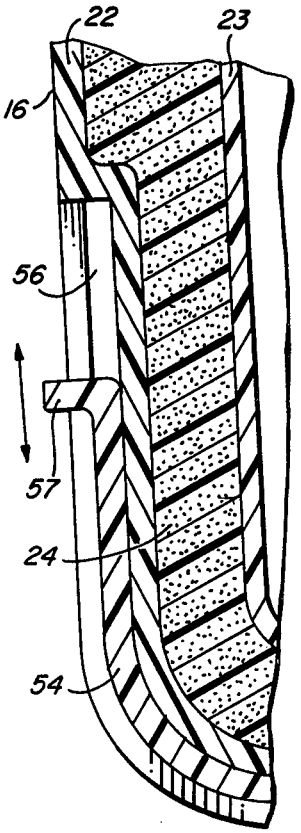
FIG. 10 is a sectional view taken generally as indicated by line 10—10 in FIG. 8.

Shields 52 also preferably have molded as integral parts thereof manipulating extensions 54 which extend up and around the sidewalls of container body 16 and are disposed in groove tracks 56 formed in the sidewalls of the outer shell 22 of body 16 (See FIGS. 9 and 10). At the end of each shield extension 54 there is provided a thumb lever 57 protruding from the side of the container body 16. By pushing down on thumb levers 57 the user of the container can move shields 52 over the face of magnet 51 to reduce the attractive force available from the magnet. Conversely, by lifting thumb levers 57 the shunt shields 52 are withdrawn from the face of magnetic 51 allowing it to exert its maximum attractive force on a supporting structure.

A further, and optional, feature of the container of this invention is a provision for holding on the lid of the container, a drink bottle, such as a vacuum bottle (not shown). As shown in FIG. 1 and FIG. 12, the upper surface of container lid 17 may be provided with an indentation 58 for receiving such a drink bottle which can be held in place in the indentation 58 by means of a flexible hold down strap 59 which has one end pivotally connected to the lid by means of fasteners 61 and the other end releasably held by a thumb latch 62 adapted to be received in a slot 63 in the end of the hold down strap (see FIGS. 12 and 13).

FIG. 7 illustrates a modification of the construction of the mating portions of lid 17 and container body 16 to improve the seal between these components and reduce the transmission of heat therethrough as well as to provide an alternative mechanism for locking the cover 17 in its closed position. As shown in FIG. 6, the breaker flange region 64 of the body inner liner 23 can be provided with a stepped configuration to receive a projecting region 66 on lid inner panel 27. The locking means in this structure consists of a rib-like protuberance 67 on the projecting region 66 which is adapted to mate with a recess 68 in the vertically extending step region of breaker flange 64. The flexibility of the projecting region 66 of the lid 17 and the breaker flange region 64 of the body liner 23 permits the locking force between rib 67 and recess 68 to be overcome by a lifting force applied to the lid. However, the locking interference between rib 67 and recess 68 is sufficient to prevent accidental opening of lid 17.

What is claimed is:

1. A portable container for use by construction workers to carry food and miscellany comprising a hollow body having side and bottom walls and a top opening, the walls of said body being insulated to resist the transmission of heat therethrough, a removable tray adapted to be stored in said body, means provided on the interior of the sidewalls of said body for supporting said tray in an upper region of said body, said tray having a plurality of compartments therein adapted to snugly receive the items of food or miscellany, a lid structure hingedly mounted on said body for closing and opening the opening of said body, said lid structure being insulated to resist the transmission of heat therethrough, means for locking said lid structure in closed position on said body, means providing a handle for carrying the container, and magnet means carried by the bottom wall of said body for holding said container in position on a magnetically attractable structure, said magnet means having a lower face directed toward said attractable structure, said magnet means including movable means for reducing the attractive force thereof to facilitate removal of the container from said attractable structure, said movable means including at least one shunt shield for shunting the magnetic field of said magnet means when positioned between the lower face of said magnet means and said attractable structure, said at least one shunt shield being movably secured to the bottom wall of said body between a first position overlying the lower face of said magnet means to reduce the attractive force between said magnet means and said attractable structure and a second position withdrawn from the lower face of said magnet means for exposing the lower face thereof and allowing said magnet means to exert its maximum attractive force upon said attractive structure.

2. The container of claim 1 wherein said lid structure when in its closed position on said body having at least a portion thereof in close proximity to said tray to prevent any substantial movement of the tray away from the supporting means for the tray.

3. The container of claim 1 wherein said tray has at least one movable cover for said compartments.

4. The container of claim 2 wherein said tray has at least one movable cover for said compartments.

5. The container of claim 1 wherein said lid structure is further provided with a storage compartment therein which is accessible when said lid structure is in its open position.

6. The container of claim 2 wherein said lid structure is further provided with a storage compartment therein which is accessible when said lid structure is in its open position.

7. The container of claim 1 wherein said movable means includes a manually manipulatable member protruding from a side wall of said body and coupled to said at least one shunt shield for moving said shunt shield between said first position overlying the lower face of said magnet means and said second positon withdrawn from the lower face of said magnet means.

8. The container of claim 1 wherein means are provided on said lid structure for securing a drink bottle thereon.

9. The container of claim 1 wherein said tray has movable dividers therein for altering the size of its compartments.

10. The container of claim 2 wherein said tray has movable dividers therein for altering the size of its compartments.

* * * * *